US010215183B2

(12) United States Patent
Üresin

(10) Patent No.: US 10,215,183 B2
(45) Date of Patent: Feb. 26, 2019

(54) METHOD FOR PRESSURE AND TEMPERATURE CONTROL OF A FLUID IN A SERIES OF CRYOGENIC COMPRESSORS

(71) Applicant: LINDE AKTIENGESELLSCHAFT, Munich (DE)

(72) Inventor: Can Üresin, Winterthur (CH)

(73) Assignee: LINDE AKTIENGESELLSCHAFT, Munich (DE)

( * ) Notice: Subject to any disclaimer, the term of this patent is extended or adjusted under 35 U.S.C. 154(b) by 332 days.

(21) Appl. No.: 15/323,444

(22) PCT Filed: Jul. 2, 2015

(86) PCT No.: PCT/EP2015/001341
§ 371 (c)(1),
(2) Date: Jan. 3, 2017

(87) PCT Pub. No.: WO2016/005037
PCT Pub. Date: Jan. 14, 2016

(65) Prior Publication Data

US 2017/0159666 A1 Jun. 8, 2017

(30) Foreign Application Priority Data

Jul. 8, 2014 (DE) ..... 10 2014 010 102

(51) Int. Cl.
*F04D 27/00* (2006.01)
*F04D 17/12* (2006.01)
(Continued)

(52) U.S. Cl.
CPC ..... *F04D 27/006* (2013.01); *F04D 17/12* (2013.01); *F04D 19/02* (2013.01); *F04D 23/001* (2013.01);
(Continued)

(58) Field of Classification Search
CPC .... F04D 27/006; F04D 23/003; F04D 27/001; F04D 27/004; F04D 23/005; F25B 9/002;
(Continued)

(56) References Cited

U.S. PATENT DOCUMENTS 5,941,095 A * 8/1999 Gistau-Baguer ..... F04D 25/00 62/613
2002/0021969 A1* 2/2002 Totsuka ..... F04C 28/08 417/26
(Continued)

FOREIGN PATENT DOCUMENTS

JP H06347115 A * 12/1994

OTHER PUBLICATIONS

Yasunori, Cooling Control Device for Multi-Chamber Type Air Conditioner, Dec. 20, 1994, JPH06347115A, Whole Document.*

*Primary Examiner* — Larry Furdge
(74) *Attorney, Agent, or Firm* — Millen White Zelano & Branigan, PC

(57) ABSTRACT

A method for pressure and temperature control of fluid in a series of cryogenic compressors. An actual speed for each compressor and an actual inlet pressure and actual inlet temperature at entry are determined. The maximum speed for each compressor and a desired inlet pressure for the first compressor is provided. A speed index for each compressor is determined from the maximum speed and actual speed of each compressor. A proportional value is determined from the deviation of the actual and desired inlet pressure. A priority value is determined from the smaller of the proportional value and the smallest speed index. A desired inlet temperature for the first compressor and a desired speed for each compressor are determined from the priority value. The actual inlet temperature is adjusted to the determined desired
(Continued)

inlet temperature and the actual speed for each compressor is adjusted to the determined desired speed.

9 Claims, 1 Drawing Sheet

(51) Int. Cl.

| | |
|---|---|
| ***F04D 19/02*** | (2006.01) |
| ***F04D 23/00*** | (2006.01) |
| ***F04D 25/00*** | (2006.01) |
| ***F04D 27/02*** | (2006.01) |
| ***F25B 1/10*** | (2006.01) |
| ***F25B 49/02*** | (2006.01) |
| ***F25B 9/00*** | (2006.01) |

(52) U.S. Cl.
CPC ..... *F04D 23/003* (2013.01); *F04D 23/005* (2013.01); *F04D 25/00* (2013.01); *F04D 27/001* (2013.01); *F04D 27/004* (2013.01); *F04D 27/0261* (2013.01); *F04D 27/0276* (2013.01); *F25B 1/10* (2013.01); *F25B 9/002* (2013.01); *F25B 49/022* (2013.01); *F25B 2500/26* (2013.01); *F25B 2500/27* (2013.01); *F25B 2600/025* (2013.01); *F25B 2600/0253* (2013.01); *F25B 2700/171* (2013.01); *F25B 2700/1933* (2013.01); *F25B 2700/21151* (2013.01)

(58) Field of Classification Search
CPC .. F25B 1/10; F25B 49/022; F25B 2600/0253; F25B 2600/26
See application file for complete search history.

(56) References Cited

U.S. PATENT DOCUMENTS

| | | | |
|---|---|---|---|
| 2005/0178134 | A1 | 8/2005 | Gistau-Baguer |
| 2006/0101836 | A1 | 5/2006 | Tanaka |
| 2013/0232999 | A1 | 9/2013 | Matsui |

* cited by examiner

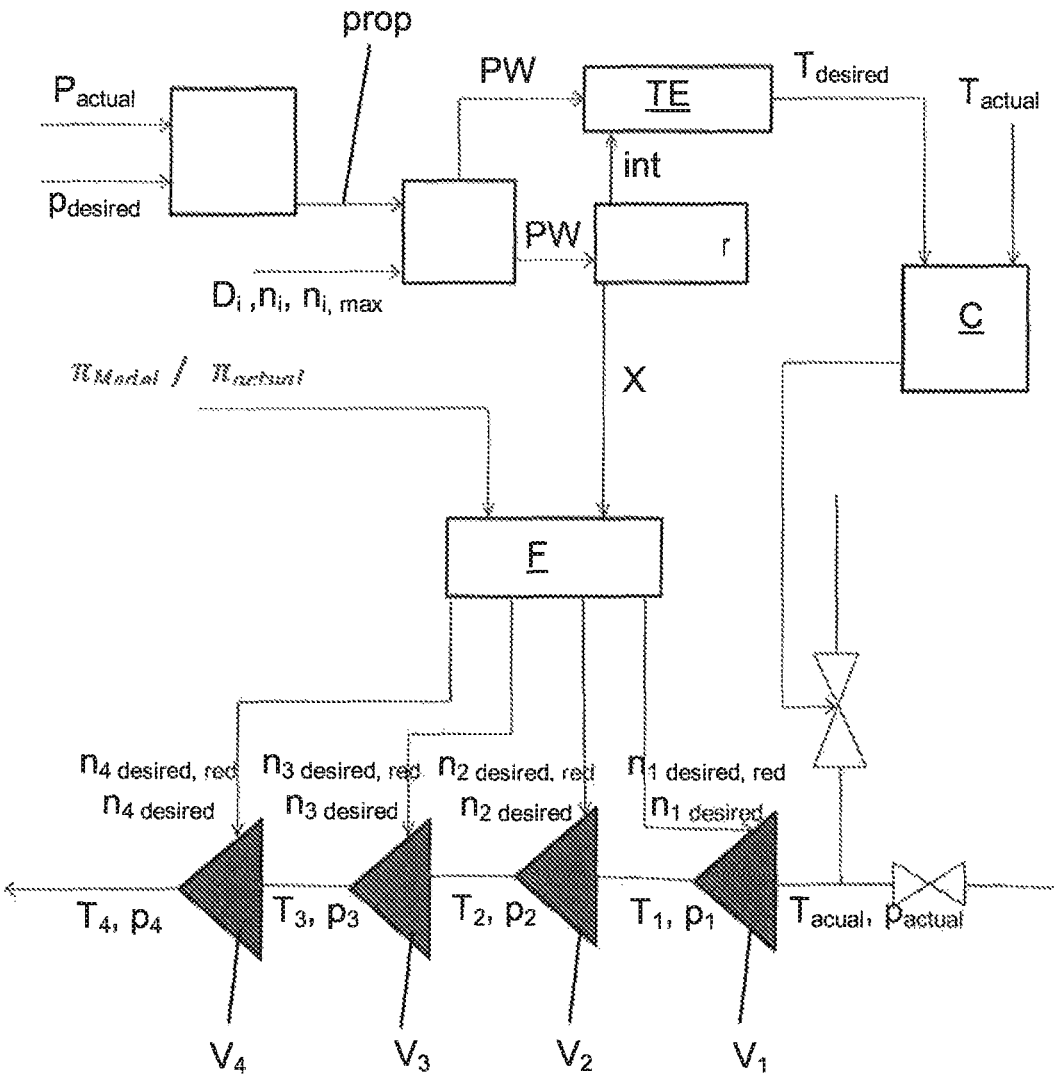
prop
PW
TE
T desired
T actual
P actual
p desired
int
PW
r
D i ,n i, n i, max
C
X
F
n4 desired, red
n4 desired
n3 desired, red
n3 desired
n2 desired, red
n2 desired
n1 desired, red
n1 desired
T4, p4
T3, p3
T2, p2
T1, p1
T acual, p actual
V4
V3
V2
V1

METHOD FOR PRESSURE AND TEMPERATURE CONTROL OF A FLUID IN A SERIES OF CRYOGENIC COMPRESSORS

The invention relates to a method for pressure and temperature control of a fluid, in particular helium, particularly during start-up of a cryogenic cooling system, or during cool-down in a series of cryogenic compressors.

Radial or turbo-compressors (hereinafter referred to as compressor) in series are used for overcoming or generating large pressure differences (at the scale of 1 bar).

Such compressors, in particular turbo compressors, are known from the prior art and typically have a shaft having at least one impeller (compressor wheel) or rotor blades directly connected to the shaft, by means of which the fluid is compressed during the rotation of the shaft. In the context of the present invention, the speed of the compressor is understood to mean the number of full rotations (360°) of the shaft about the shaft axis per unit of time. Compressors, such as turbo compressors, are subdivided, in particular, into radial compressors and axial compressors. In the case of a radial compressor, the fluid flows in axially to the shaft and is deflected in a radially outward direction. In the case of an axial compressor, however, the fluid to be compressed flows in through the compressor in a direction parallel to the shaft.

By adjusting the speeds of the compressor, the entry pressure of the fluid is controlled at a first compressor, i.e. the pressure at an entry of the most upstream compressor of the series. This determines in in particular also the entry conditions at the respective entry of the other compressors, which are downstream of the first compressor. An entry condition is determined by the pressure and the temperature at the entry point of the respective compressor. Throughout, the respective entry condition at a compressor corresponds to the respective condition of the fluid at the exit of the previous compressor. This results in that a change of the speed of a compressor also always impacts the entry conditions of the fluid inlet of the other compressors of the series.

For cryogenic systems, i.e. for cooling systems designed for very low temperatures (1.5 K-100 K), in this case in particular for temperatures between 1.5 K and 2.2 K, controlling the inlet pressure allows reaching the desired saturation temperature for the cold liquid on the suction side, i.e. the side from which the compressors aspirate the gas phase (vapor). During the compression process of the series (but also with a single compressor) the pressure at the output of the series as well as the temperature of the fluid flowing through the compressor is increased (polytropic compression process). In order to smooth the impact of operating point fluctuations, so-called reduced variables are used, such as the reduced mass flow through the compressor or the reduced speed of the compressor during control. For calculating these reduced variables, the dimension as such is required (i.e., for example the mass flow or the speed of the compressor), the temperature, the pressure and the set values (or even specifications) of the compressor. The set values are the operating conditions of a compressor in which the compressor operates at greatest efficiency (most economical manner). Compressors have set values, for example, with respect to the speed, the temperature and pressure of the respective compressor. The goal is to operate the compressor of the series in proximity to their specifications.

Usually, during start-up of such a cryogenic refrigeration system, the fluid on the suction side of the compressor series is initially cooled down very much (for example, from 300 K to 4 K). This can happen at atmospheric pressure, i.e. 1 bar. Lower temperatures are then realized via suppression. This process is also called cool-down. The pressure reduction on the suction side of the system occurs by starting up the compressor series. It serves in particular to lower the temperature above the fluid further (pump-down). The temperature increase of the fluid due to the compression process during flow through of the compressor series of, for example, three or four compressors, is situated within the range of approximately 4K to 23K.

Provided the compressor of series are not in operation, i.e. if no compression is taking place, the temperature of the mass flow is 4K at the outlet of the compressor series, which, as will be explained below, can be problematic. A heat exchanger used for cooling a parallel mass flow, situated downstream of the compressor series might for example be designed for 23K. If such heat exchanger, however, as been perfused with the 4K cold mass flow from the compressor series for a longer period, the parallel mass flow inside the heat exchanger is cooled down very much. Since downstream, this parallel mass flow is expanded only via a turbine, condensation of the parallel mass flow could take place inside the turbine. In order to avoid this condensation, the turbine is switched off, whereby the cooling process is temporarily interrupted. These operating conditions are to be avoided and are referred to as trip of the system. If, on the other hand, the compressors are started at the same time as the system, thus compressing the fluid, warm fluid from the suction side flows through the compressor, since the system is still warm. At these temperatures, the gas density of the fluid is very low. Due to a predetermined desired pressure of e.g. 20 mbar, the compressors will feature very high speeds on the suction side. The high gas temperature, however, means that the compressors quickly reach their maximum speeds. The cause of the high speeds is, on the one hand, the low predetermined desired pressure and, on the other hand, the relatively high temperatures at the compressors. During a worst-case scenario, overspeeds result. Overspeeds are speeds for which the compressors are not designed, and should therefore be avoided. Therefore, fluid compression in the compressor series should repeatedly be interrupted during parallel cool-downs and pump-downs so that the temperature in the compressors cannot increase by too much. As mentioned above, the temperature also co-enters the reduced control variables, such as reduced speed. This means that an increase in the temperature at the compressor causes an increase of the reduced speed. It would therefore be desirable to dispose of a temperature control for the entry of the compressor series, especially for the cool-down and/or the pump-down phase, which ensures uninterrupted pump-down at simultaneous cool-down.

This problem is solved by the method according to the invention. The following steps are provided throughout:

- Detecting an actual speed for each compressor, wherein the actual speed is the current speed of the compressor,
- Detecting an actual inlet pressure and an actual inlet temperature at the inlet of the most upstream, first compressor of the series, wherein the flow direction of the series, especially from the compressor suction side points toward increasing pressure and wherein the actual inlet temperature and the actual inlet pressure are in particular the current temperature and/or the current pressure at the inlet of the first compressor,
- Setting a maximum speed for each compressor of the series and a desired inlet pressure of the first compressor of the series, wherein the maximum speed is the maximum permitted speed of the respective compressor at which stable operations of the respective compressor is ensured, and wherein the desired inlet pressure corresponds to the pressure desired at the inlet of the first compressor, Determining a speed index for each compressor of the series from the maximum speed and the actual speed of each compressor, Determining a proportional value from the deviation of the actual from the desired inlet pressure, Determining a priority value from the smaller of the two values: proportional value and the smallest speed index of all compressors of the series (preferably, the priority value equals the smaller of the two indicated values)

Determining a desired inlet temperature for the first compressor of the series and a desired speed for each compressor from the priority value, Adjusting the actual inlet temperature of the first compressor, relative to the detected desired inlet temperature, Adjusting the actual speed for each compressor relative to the detected desired speed.

The proportional value is in particular proportional to the difference between the desired inlet pressure and the actual inlet pressure:

$$\text{prop}=-k(p_{desired}-p_{actual}).$$

wherein k is a proportionality factor.

The priority value thus primarily determines, which of the two values, the proportional value or the smallest of the speed indices, will be used for controlling the compressor series. If the priority value corresponds for example to the proportional value, then the control priority is pressure control (i.e. in particular the pump-down) since the proportional value especially reflects the pressure difference as control value. If the priority value corresponds to the smallest speed index, then the control priority is in particular the inlet temperature at the first compressor. Under such control, the compressor speeds should not rise further.

For determining the desired speed for each compressor, the respective inlet temperatures are detected in particular at the entry of each compressor of the series.

The method according to the invention allows carrying out the pump-down process in parallel with the cool-down. Due to the method according to the invention, the temperature does not drop any further as soon as the cool-down process is terminated. In addition, the temperature of the fluid is thus regulated across a temperature range suitable for the downstream components, e.g. heat exchangers, already at the output point.

Another advantage is that overspeeds are avoided for all compressors, since especially a reduction of the inlet temperature results in lower speeds. For the method according to the invention, it is furthermore advantageous that the pump-down process can occur without interruption, which would for example be required for excessive compressor speeds.

It is furthermore advantageous that the impact of unwanted heat supply from the environment, i.e. from outside, can be minimized. Furthermore, it is particularly advantageous that during the pumping-down operation, the desired inlet temperature can be controlled automatically and transiently. The method according to the invention is particularly also suitable for temperature control in supercritical helium pumps.

A preferred variant of the invention provides that the speed index for each compressor corresponds to the ratio (quotient) from the difference of the maximum speed $n_{i\ max}$ and the actual speed $n_i$ of the respective compressor and the maximum speed:

$$D_i = \frac{n_{i,max} - n_i}{n_{i,max}} = 1 - \frac{n_i}{n_{i,max}},$$

wherein i is the index denoting the respective compressor.

Especially preferred, the priority value impacts the control in such a manner that, if the smallest speed index of all compressors is smaller than the proportional value, the actual inlet temperature will be lowered—in particular by gradual or continuous reduction of the detected desired inlet temperature—until the proportional value is smaller than the speed index, and that, in particular, the actual speed of the respective compressor is not increased for as long as the smallest speed index is smaller than the proportional value. The proportional value is used in particular for controlling the actual input pressure.

In a preferred variant of the invention, the actual speed of each compressor is determined from a reduced actual speed and the desired speed of each compressor is determined from a reduced desired speed, wherein the reduced actual speed is determined from the actual speed and an actual temperature at the entry of the respective compressor, and wherein the reduced desired is determined speed from the desired speed and the actual temperature at the entry of the respective compressor. The detailed conversion of reduced variables into real/absolute variables is shown in an exemplary formula below.

In a variant of the invention, an integral value is determined from the priority value wherein the integral value is used in particular for determining the reduced desired speed. Throughout, the integral value is in particular composed of the proportional value prop or, generally, the priority value to the integral value $\text{int}_{t=n+1}$. The proportional value prop and/or the priority value PW is then multiplied by a cycle time $\Delta_t$, an integral $T_{int}$, divided by and added to the integral value of the previous cycle $_{int=n}$:

$$int_{t=n+1} = int_{t=n} + prop \cdot \frac{\Delta t}{T_{int}}$$

and/or $$int_{t=n+1} = int_{t=n} + PW \cdot \frac{\Delta t}{T_{int}}$$

In a preferred variant of the invention, an actual total pressure ratio is determined, wherein the actual total pressure ratio equals the quotient from an actual outlet pressure, which corresponds to the pressure at an output of the farthest downstream compressor, and the actual inlet pressure of the first compressor.

In a variant of the invention, a capacity factor is determined from the actual total pressure ratio and a proportional integral value determined from the priority value and the integral value, wherein the reduced desired speed for each compressor is determined as a functional value of a control function attributed to the respective compressor, which attributes a reduced desired speed to each value pair, consisting of a capacity factor and a model total pressure ratio (determined in particular from the actual total pressure ratio).

BRIEF DESCRIPTION OF THE DRAWING

The following illustration descriptions detail preferred variants and examples, as well as other features of the method according to the invention:

The drawing FIGURE is a schematic illustration of the method according to the invention.

The drawing figure is a schematic illustration of a process diagram, which can be used for implementing the method according to the invention. Four compressors $V_1$, $V_2$, $V_3$, $V_4$ are arranged in a series, and each features an inlet pressure $p_{actual}$, $p_1$, $p_2$, $p_3$ at its suction side and a temperature $T_{actual}$, $T_1$, $T_2$, $T_3$ at its entry point. Upstream of the first compressor $V_1$ of the series, there is an inlet for cold fluid at a temperature $T_{coldbox}$ (for example 200K, 100K, 50K, 20K and/or 4K), which can be added to the fluid requiring cooling in particular via a valve. For each compressor $V_1$, $V_2$, $V_3$, $V_4$, temperature $T_{actual}$, $T_1$, $T_2$, $T_2$, $T_3$ is determined at entry point. For the first compressor $V_1$ this is the actual inlet temperature $T_{actual}$. Furthermore, the actual pressure $p_{actual}$, $p_1$, $p_2$, $p_3$ is also determined at the input of the respective compressor $V_1$, $V_2$, $V_3$, $V_4$. An actual total pressure ratio $\pi_{actual}$ is calculated from the actual inlet pressure $p_{actual}$ and the actual outlet pressure $p_4$. This serves to determine the reduced speeds $n_{1desired,\ red}$, $n_{2desired,\ red}$, $n_{3desired,\ red}$, $n_{4desired,\ red}$ of compressors $V_1$, $V_2$, $V_3$, $V_4$:

$$\pi_{actual} - \frac{p_4}{p_{actual}}$$

From the actual and desired inlet pressures $p_{actual}$, $p_{desired}$ as well as the actual total pressure $\pi_{actual}$, it is possible to determine a capacity factor X that is equal to all compressors $V_1$, $V_2$, $V_3$, $V_4$. This capacity factor X serves to determine for each compressor $V_1$, $V_2$, $V_3$, $V_4$ the respective reduced desired speeds $n_{1desired,\ red}$, $n_{2desired,\ red}$, $n_{3desired,\ red}$, $n_{4desired,\ red}$ via a control function F attributed to each respective compressor $V_1$, $V_2$, $V_3$, $V_4$ (pre-calculated for each compressor in the form of e.g. a table or a polynome) so that the compressors $V_1$, $V_2$, $V_3$, $V_4$ of the series work in a most economical manner.

The capacity factor X in particular is of such nature that it can accept values between 0 ($X_{pump}$=0 pumping regime) and 1 ($X_{block}$=1, blocking regime). Both the pumping and the blocking regimes are operating conditions of the compressor, which should be avoided. The pumping regime corresponds to the operating states, in which the compressor satisfies the so-called surge condition whereas, on the other hand, the blocking regime corresponds to operating conditions that meet the so-called choke condition. In order for the compressors not to enter these regimes, the capacity factor X gets limited to values between a minimum value $X_{min}=X_{pump}+0.05$ and a maximum value $X_{max}=X_{block}-0.1$.

Likewise, for the integral value $int_{t=n+1}$, an upper and a lower limit value $int_{max}$ and/or $int_{min}$ of integral value int are derived via $X_{max}$ and/or $X_{min}$ and from the natural logarithm of the actual total pressure ratio $\ln(\pi_{actual})$:

$$int_{min}=X_{min}+\ln(\pi_{actual})$$

$$int_{min}=X_{min}+\ln(\pi_{actual}).$$

Since the measured actual total pressure ratio $\pi_{actual}$ continues to increase during transient mode (pump-down) (the actual inlet pressure $p_{actual}$ continues to decrease), the limits of the integral value also increase. In the opposite case (pump-up), i.e. if the desired inlet pressure $p_{desired}$ is smaller than the actual inlet pressure $p_{actual}$, those limit values continue to decrease.

If the integral value $int_{t=n+1}$ is greater and/or smaller than the upper and/or lower limit value $int_{max}$, $int_{min}$, it will be limited to the respective limit value.

Priority value PW and integral value $int_{t=n+1}$ are added together in order to generate a proportional-integral PI value:

$$PI=PW+int_{n+1}$$

If all compressors $V_1$, $V_2$, $V_3$, $V_4$ run in series at their specification points, the compressor series reaches its design or operating at a design total pressure ratio $\pi_{design}$.

If the proportional-integral value PI is smaller than the sum of the maximum value of the capacity factor $X_{max}$ and than the natural logarithm of the design total pressure ratio value $\pi_{design}$, the capacity factor X is determined from the difference of the proportional-integral value PI and the natural logarithm of the actual total pressure ratio $\pi_{actual}$. Otherwise, the proportional-integral PI value is limited to the sum of the natural logarithm of the design total pressure ratio $\pi_{Design}$ and the maximum value of the capacity factor $X_{max}$ in particular when determining capacity factor X. The following thus applies:

$$X=PI-\ln(\pi_{actual})_{if}\ PI<\ln(\pi_{Design})+X_{block}$$

$$X=\ln(\pi_{Design})+X_{block}-\ln(\pi_{actual}),\text{otherwise}$$

based on the capacity factor X determined in such manner, the process according to the invention now chooses how a model total pressure ratio $\pi_{model}$ is determined, which is then handed to the control function F for determining the reduced desired speeds $n_{1desired,\ red}$, $n_{2desired,\ red}$, $n_{3desired,\ red}$, $n_{4desired,\ red}$. The model total pressure ratio $\pi_{model}$ is equal to the actual total pressure ratio $\pi_{actual}$, provided the determined capacity factor X is situated between the minimum and maximum values $X_{min}$, $X_{max}$ is. Provided the capacity factor X is outside this value range, then the model total pressure ratio $\pi_{Model}$ is altered is altered via a saturation function SF.

Subsequently, the capacity factor X is limited to its minimum and/or maximum values $X_{min}$, $X_{max}$ is restricted. In particular, in conjunction with the model total pressure ratio $\pi_{model}$, it is redirected to control function F, which uses these arguments as foundation to determine the reduced desired speeds $n_{1\ desired\ red}$, $n_{2\ desired,\ red}$, $n_{3\ desired,\ red}$, $n_{4\ desired,\ red}$ for the respective compressors $V_1$, $V_2$, $V_3$, $V_4$.

The saturation function SF can be given for values of the capacity factor X, which are not situated between the minimum and the maximum values $X_{min}$, $X_{max}$, for example via $$SF=\exp(0,5*(X-X_{max}))_{for}\ X>X_{max}$$

and/or $$SF=\exp(0,5*(X-X_{min}))_{for}\ X<X_{min}$$

This means:

$$\pi_{Model}=\pi_{actual}\cdot SF \Leftrightarrow \ln(\pi_{Model})=\ln(\pi_{actual})+0,5\cdot(X-X_{min/max}).$$

This modification of the model total pressure ratio $\pi_{model}$ ensures that in operating states in which the capacity factor X is at saturation, the control continues to nevertheless have an impact on compressors $V_1$, $V_2$, $V_3$, $V_4$, since then, the model total pressure ratio $\pi_{model}$ is changed instead of the capacity factor X, allowing control function F to request reduced desired speeds $n_{1desired,\ red}$, $n_{2desired,\ red}$, $n_{3desired\ red}$, $n_{4desired}$ leading out of these operating states.

The reduced desired speeds $n_{1desired,\ red}$, $n_{2desired,\ red}$, $n_{3desired\ red}$, $n_{4desired}$ can be deposited for each compressor $V_1$, $V_2$, $V_3$, $V_4$, especially in the form of a table (look-up table). This table can be created in particular by model calculations using Euler's turbomachinery equations. In accordance with capacity factor X and the model total pressure ratio $\pi_{Model}$, a software for reading the reduced desired speeds $n_{1desired,\ red}$, $n_{2desired,\ red}$, $n_{3desired,\ red}$, $n_{4desired}$ from the table can be used. This table then corresponds in particular the control function F and comprises, at least for a number of capacity factors X (for example, X=0, 0.25, 0.5, 0.75 and 1), and model total pressure ratios $\pi_{model}$ the respective reduced speeds $n_{1desired,\ red}$, $n_{2desired,\ red}$, $n_{3desired\ red}$, $n_{4desired}$ for the respective compressor $V_1$, $V_2$, $V_3$, $V_4$. Values of the capacity factor X not listed in the table, are determined by interpolation. Furthermore, the capacity factor X as a function of the model total pressure ratio $\pi_{Model}$ and reduced speeds $n_{1desired,\ red}$, $n_{2desired,\ red}$, $n_{3desired\ red}$, $n_{4desired}$ $n_{red}$ is chosen so that the actual inlet pressure $p_{actual}$ aligns with the desired inlet pressure $p_{desired}$ via the control function F.

In order to ensure a system pump-down in parallel with the cool-down, i.e. reducing the pressure to the suction side of compressors $V_1$, $V_2$, $V_3$, $V_4$ during the cooling phase, it must be decided whether the actual inlet temperature $T_{actual}$ must be lowered at the entry of the first compressor $V_1$ in order to avoid excessively high speeds in the compressors $V_1$, $V_2$, $V_3$, $V_4$ or whether the operation can be ensured without additional cooling at the entry of the first compressor $V_1$. For this purpose, two values are compared with each other. At first, a proportional value prop is calculated from the actual and desired inlet pressures $p_{actual}$, $p_{desired}$. Then, a speed index is calculated from a speed quota for each compressor calculated. And secondly, a speed index is calculated for each compressor from a speed quota, wherein the speed quota is given by $$Q_i = \frac{n_i}{n_{i,max}}$$

and the speed index $D_i$ is given by $$D_i = 1 - Q_i = 1 - \frac{n_i}{n_{i,max}}$$

where $n_{i,max}$ equals the maximum speed of the respective compressor $V_i$. i is an index (i=1-4).

Hence, if the speed index $D_i$ of a compressor $V_i$ tends towards zero, this means that compressor $V_i$ is operating near its maximum speed $n_{i,\ max}$, and no higher speeds $n_i$ should be set by increasing the reduced desired speeds $n_{1desired,\ red}$, $n_{2desired,\ red}$, $n_{3desired\ red}$, $n_{4desired,\ red}$.

From the amount of speed indices $D_i$ for each compressor $V_i$, the smallest speed index $D_i$ will now be compared with the proportional value prop. The smaller of the two values is assigned to priority value PW, which then serves to determine further control values (such as for example the reduced desired speeds $n_{1desired,\ red}$, $n_{2desired,\ red}$, $n_{3desired\ red}$, $n_{4desired\ red}$, in particular by means of the capacity factor or the desired inlet temperature $T_{desired}$). This means that if a compressor $V_i$ already operates at very high speeds $n_i$, its speed index $D_i$ will be nearly or equal to zero. This prioritizes the system control in a manner as to adding cold fluid upstream of the inlet of the first $V_1$ via a cooling reservoir, so that the actual inlet temperature $T_{actual}$ is lowered. As a result, speeds $n_i$ compressors $V_i$, decrease, so that the speed index $D_i$ of this compressor $V_i$ increases again—and namely, in particular, until the proportional value prop will be lower. This ensures an an economical operation of the compressor series, especially during the cool-down and pump-down phases.

From the priority value PW, a temperature control unit TE determines the desired inlet temperature $T_{desired}$. Throughout, the calculation is of a qualitative nature as to ensure that in case of a low priority value PW, the desired inlet temperature T gets gradually reduced. For example, the desired inlet temperature $T_{actual}$ can be set at 90% of the most recently measured actual inlet temperature $T_{actual}$. The downgrade to this value can for example be realized via a ramp function. If during the downgrading of the desired inlet temperature $T_{desired}$, the speed indices still enjoy priority status, the desired inlet temperature the $T_{actual}$ will be newly reduced to 90% of the last measured actual inlet temperature $T_{actual}$. For each downgrade of the desired inlet temperature $T_{actual}$ to 90% of the measured actual inlet temperature $T_{actual}$, it will be verified whether the determined desired inlet temperature $T_{desired}$ is greater than a specified temperature at the inlet of the compressor series. Provided the specified temperature is 4K, and the temperature desired value is 3.8 K, then the value will be limited to 4K.

Via a cooling reservoir control box C, the respective amount of cold fluid will be impinged on the warm fluid upstream of the entry of the first compressor $V_1$ so that by mixing the two differently warm fluids, the fluid has a mixture temperature that is lower than the previously measured actual inlet temperature $T_{actual}$. At a higher priority value PW, the at the inlet of the first compressor $V_1$ will be impinged on with no or only a small amount of cold fluid, since compressors $V_1$, $V_2$, $V_3$, $V_4$ of the series already run at non-excessive speeds $n_1$.

In a variant of the invention, an integrator, which is in particular part of a PI (proportional-integral) controller, and which carries out a temporal integration of the priority value PW, can also impact the calculation of the desired inlet temperature $T_{desired}$—for example in a manner as to reach a certain steepness of a temperature ramp for $T_{desired}$.

It is important throughout the entire control that reduced values for controlling the system and, in particular, compressors $V_1$, $V_2$, $V_3$, $V_4$ be used. The reduced speed $n_{i,red}$ of a compressor $V_1$ can thus for example be calculated via the following formula.

$$n_i = n_{i,red} \cdot n_{i,Design} \cdot \sqrt{\frac{T_{i-1}}{T_{i,Design}}}$$

wherein $n_i$ is the speed of the compressor (desired or actual speed), $n_{i,\ red}$ the reduced speed (desired or actual speed) of the compressor $V_i$, $n_{i,\ design}$ the specified or design speed of the compressor $V_i$. $T_{i-1}$ the temperature at the inlet of the compressor $V_i$, and $T_{i,\ design}$ the specified or design temperature of the compressor $V_i$. Wherein $T_0$($_i$=1) equals the actual inlet temperature $T_{actual}$ of the first compressor $V_1$. In a parallel manner, the following applies for reduced mass flow $\dot{m}_{red}$:

$$\dot{m}_{red} = \frac{\dot{m}_{actual}}{\dot{m}_{Design}} \cdot \frac{p_{Design}}{p_{actual}} \cdot \sqrt{\frac{T_{actual}}{T_{Design}}}$$

wherein $\dot{m}_{red}$ represents the reduced mass flow through the compressor, $m_{actual}$ the current mass flow, $\dot{m}_{Design}$ the mass flow designating the one specified for the respective compressor, $p_{Design}$ the specified pressure at the respective compressor, $T_{Design}$ is specified temperature and $p_{actual}$ the actual inlet pressure at the respective compressor.

REFERENCE SIGN LIST

| | |
|---|---|
| PW | Priority value |
| prop | Proportional value |
| int | Integral Value |
| $p_{ist}$ | Actual inlet pressure at first compressor |
| $p_{desired}$ | Desired inlet pressure at first compressor |
| TE | Temperature control unit |
| C | Cooling reservoir control box |
| F | Control function |
| X | Capacity factor |
| $D_i$ | Speed index of I compressor (i = 1-4) |
| $n_i$ | Actual speed of i compressor (i = 1-4) |
| $n_{i,max}$ | Maximum speed of I compressor (i = 1-4) |
| $V_i$ | I compressor of series (i = 1-4) |
| $p_i$ | Actual pressure at outlet of i compressor, and/or entry of (i + 1) compressor (i = 1-4) |
| $n_{i,desired}$ | Desired speed of i compressor (i = 1-4) |
| $n_{i,desired,red}$ | Reduced desired speed of i compressor (i = 1-4) |
| $n_{i,Design}$ | Specified and/or designed speed of i compressor (i = 1-4) |
| $T_{ist}$ | Actual inlet temperature (at first compressor) |
| $T_{desired}$ | Desired inlet temperature (at first compressor) |
| $T_i$ | Actual temperature at entry of (i + 1) compressor, at outlet of i compressor (i = 1-4) |
| $T_{i,Design}$ | Specified and/or designed temperature of i compressor (i = 1-4) |
| $T_{coldbox}$ | Temperature of cold fluid |
| SF | Saturation function |
| $\pi_{Model}$ | Model total pressure ratio |
| $\pi_{actual}$ | Actual total pressure ratio |
| $\pi_{Design}$ | Design total pressure ratio |
| X | Capacity factor |
| $X_{min}$ | Minimum value of capacity factor |
| $X_{max}$ | Maximum value of capacity factor |
| PI | Proportional-Integral value |

The invention claimed is:

1. A method for pressure and temperature control of a fluid in a series of cryogenic compressors, said method comprising:

detecting an actual speed for each compressor, detecting an actual inlet pressure and an actual inlet temperature at the entry of the most upstream, first compressor of the series, specifying a desired inlet pressure for said first compressor of the series, determining a speed index for each compressor from a maximum speed of the respective compressor and the actual speed of the respective compressor, determining a proportional value from the deviation of the actual inlet pressure from the desired inlet pressure, determining a priority value, wherein the priority value is determined from the proportional value, if the proportional value is smaller than the smallest speed index of all compressors of the series, and wherein the priority value is determined from the smallest speed index among all compressors of the series, if the proportional value is greater than the minimum speed index among all compressors of the series, determining a desired inlet temperature for the first compressor of the series and a desired speed for each compressor, with the aid of the priority value, adjusting the actual inlet temperature of said first compressor to the determined desired inlet temperature, and adjusting the actual speed for each compressor to the determined desired speed for each compressor.

2. The method according to claim 1, wherein the speed index for each compressor corresponds to the ratio of the difference between the maximum speed and the actual speed of each compressor, and the maximum speed.

3. The method according to claim 1, wherein the priority value influences the control in such a manner that if the smallest speed index of all compressors is smaller than the proportional value, the actual inlet temperature will be lowered, until the proportional value is smaller than the smallest speed index.

4. The method according to claim 1, wherein the actual speed of each compressor is determined from a reduced actual speed, and the desired speed of each compressor is determined from a reduced desired speed, wherein the reduced actual speed is determined from the actual speed and an actual temperature at the entry of the respective compressor, and wherein the reduced desired speed is determined from the desired speed at the entry of each compressor.

5. The method according to claim 1, further comprising determining an integral value from the priority value, wherein the integral value is used to determine a reduced set speed of the respective compressor.

6. The method according to claim 1, further comprising determining an actual total pressure ratio, wherein the actual total pressure ratio corresponds to the quotient of an actual outlet pressure corresponding to the pressure at an outlet of the farthest upstream compressor, and the actual inlet pressure of the first compressor.

7. The method according to claim 6, wherein a capacity factor is determined from the actual total pressure ratio and a proportional-integral value of the priority value and an integral value is determined, wherein a reduced desired speed for each compressor is determined as a functional value of control function attributed to the respective compressor, which assigns a reduced desired speed to each value pair, from capacity factor and model total pressure ratio, which is determined by or equal to the actual total pressure ratio.

8. The method according to claim 3, wherein, if the smallest speed index of all compressors is smaller than the proportional value, the actual inlet temperature is lowered by gradually lowering the determined desired inlet temperature.

9. The method according to claim 3, wherein the actual speeds of the compressors are not increased as long as the smallest speed index is smaller than the proportional value.

* * * * *